US009375076B2

(12) United States Patent
Weis et al.

(10) Patent No.: US 9,375,076 B2
(45) Date of Patent: Jun. 28, 2016

(54) BROOM HEAD

(75) Inventors: Norbert Weis, Weinheim (DE); Hans-Jörg Clemen, Heidelberg (DE); Marc Hunger, Viernheim (DE)

(73) Assignee: Carl Freudenberg KG, Weinheim (DE)

( * ) Notice: Subject to any disclaimer, the term of this patent is extended or adjusted under 35 U.S.C. 154(b) by 0 days.

(21) Appl. No.: 14/366,027

(22) PCT Filed: Sep. 5, 2012

(86) PCT No.: PCT/EP2012/003715
§ 371 (c)(1),
(2), (4) Date: Jul. 1, 2014

(87) PCT Pub. No.: WO2013/091740
PCT Pub. Date: Jun. 27, 2013

(65) Prior Publication Data

US 2014/0331426 A1 Nov. 13, 2014

(30) Foreign Application Priority Data

Dec. 22, 2011 (DE) ..... 10 2011 122 105

(51) Int. Cl.

| | |
|---|---|
| ***A47L 13/12*** | (2006.01) |
| ***A46B 7/04*** | (2006.01) |
| ***A46B 9/04*** | (2006.01) |
| *A46B 9/00* | (2006.01) |

(52) U.S. Cl.
CPC . *A46B 7/04* (2013.01); *A46B 9/005* (2013.01); *A46B 9/04* (2013.01); *A47L 13/12* (2013.01); *A46B 9/00* (2013.01); *A46B 2200/302* (2013.01)

(58) Field of Classification Search
CPC ..... A46B 9/04; A46B 2200/302; A46B 7/04; A46B 9/00; A46B 9/005; A47L 13/12
USPC ..... 15/106, 111, 114, 115, 117, 159.1, 171, 15/202
See application file for complete search history.

(56) References Cited

U.S. PATENT DOCUMENTS 638,305 A * 12/1899 Wightman ..... 119/612
1,196,522 A * 8/1916 Christiansen ..... 132/120
(Continued)

FOREIGN PATENT DOCUMENTS

CN 101647683 A 2/2010
DE 10332405 A1 2/2005
(Continued)

*Primary Examiner* — Michael Jennings
(74) *Attorney, Agent, or Firm* — Fraser Clemens Martin & Miller LLC; James D. Miller

(57) ABSTRACT

In respect of the problem of indicating a broom head (1) which can be produced such that its individual parts are easy to store, wherein the individual parts are fixed to one another following production of the broom head, said broom head (1) comprising a basic body (2) with a plate (3), from which project first cleaning elements (4) for directing towards a surface which is to be cleaned, wherein the plate (3) also has second cleaning elements (5), which assist the cleaning performance of the first cleaning elements (4), projecting from it, is characterized in that the second cleaning elements (5) are arranged on a module (6) which can be introduced, as a separate individual part, into an aperture (9) of the plate (3) such that the second cleaning elements (5) engage through the plate (3).

15 Claims, 5 Drawing Sheets

(56) References Cited

U.S. PATENT DOCUMENTS

| | | | | |
|---|---|---|---|---|
| 1,291,065 | A * | 1/1919 | Melton | 15/171 |
| 2,446,086 | A * | 7/1948 | Hermans | 132/120 |
| 2,488,056 | A * | 11/1949 | Eisner et al. | 401/278 |
| 2,518,765 | A * | 8/1950 | Ecker | A47L 13/12 15/115 |
| 2,704,853 | A * | 3/1955 | Gantz | 15/168 |
| 3,034,165 | A * | 5/1962 | Christian | 15/247 |
| 3,619,845 | A * | 11/1971 | Partridge et al. | 15/117 |
| 4,932,425 | A * | 6/1990 | Chen | 132/119 |
| 4,988,228 | A * | 1/1991 | Yeh | 401/289 |
| 5,274,873 | A * | 1/1994 | Shields | 15/167.1 |
| 5,522,110 | A * | 6/1996 | Borofsky | 420/406 |
| 5,552,110 | A | 9/1996 | Iba et al. | |
| 6,182,671 | B1 * | 2/2001 | Taylor et al. | 132/116 |
| 6,217,124 | B1 * | 4/2001 | Jespersen | 300/21 |
| 6,261,156 | B1 * | 7/2001 | Johnson et al. | 451/41 |
| 7,159,950 | B2 * | 1/2007 | Young-Chul | 300/21 |
| 7,836,540 | B2 * | 11/2010 | Vasilakes | A46B 15/0002 15/1.52 |
| 7,861,360 | B2 * | 1/2011 | Malka | 15/169 |
| 8,196,249 | B1 * | 6/2012 | Spooner et al. | 15/117 |
| 8,438,689 | B2 * | 5/2013 | Noble | 15/207.2 |
| 2003/0163884 | A1 * | 9/2003 | Weihrauch | 15/207.2 |
| 2004/0031116 | A1 * | 2/2004 | Coleman | 15/172 |
| 2004/0158948 | A1 * | 8/2004 | Sander et al. | 15/188 |
| 2005/0132517 | A1 * | 6/2005 | Weckemann et al. | 15/111 |
| 2006/0048324 | A1 * | 3/2006 | Vassilopoulos | 15/179 |
| 2008/0189890 | A1 * | 8/2008 | Arnold et al. | 15/117 |
| 2010/0132625 | A1 * | 6/2010 | Dionne | 119/602 |
| 2010/0199449 | A1 * | 8/2010 | Ho et al. | 15/207.2 |
| 2011/0239390 | A1 * | 10/2011 | Park | 15/160 |

FOREIGN PATENT DOCUMENTS

| | | | |
|---|---|---|---|
| DE | 10362035 | A1 | 3/2005 |
| DE | 102008016637 | A1 | 10/2009 |
| EP | 1595473 | A1 | 11/2005 |
| GB | 2151467 | A | 7/1985 |
| WO | 2006122607 | A1 | 11/2006 |

* cited by examiner

BROOM HEAD

CROSS-REFERENCE TO RELATED APPLICATIONS

This application is a United States national phase application based on PCT/EP2012/003715 filed Sep. 5, 2012 which claims the benefit of German Patent Application Serial No. 102011122105.4 filed Dec. 22, 2011. The entire disclosures of the above applications are hereby incorporated herein by reference.

TECHNICAL FIELD

The invention relates to a broom head according to the preamble of patent claim 1.

PRIOR ART

Broom heads, which can be connected to a handle, are known from the prior art. Such a broom head comprises a basic body with a plate, from which cleaning elements to be turned toward a surface to be cleaned project. Moreover, lamellae project from the plate in the direction of the surface to be cleaned and assist the cleaning capacity of the cleaning elements.

The lamellae can remove from a surface to be cleaned dirt particles or moisture which can be removed only inadequately by the cleaning elements, in particular bristles.

The lamellae may be fastened either to the plate or to a cap which has a receptacle for a handle. When a broom head is being manufactured, the plate and the cap are connected to each other in order to form the basic body. In this manufacturing method, however, considerable problems arise where stockkeeping is concerned, since both a plate with lamellae and a cap with lamellae are relatively bulky and difficult to store.

PRESENTATION OF THE INVENTION

The object on which the invention is based, therefore, is to specify a broom head which can be manufactured so that its individual parts can easily be kept in stock, the individual parts being connected firmly to each other after the manufacture of the broom head.

The present invention achieves the abovementioned object by means of the features of patent claim 1.

According to the invention, the second cleaning elements are arranged on a module which can be inserted as a separate individual part into the plate. It was recognized, according to the invention, that a second module makes it possible to stack and store the plate and cap easily as flat individual parts, since these themselves have no second cleaning elements. The separate module likewise has a flat configuration and can therefore be stored easily. In a manufacturing process, these three individual parts can quickly be joined together captively and thus form a broom head. The flat individual parts allow simple and cost-effective stockkeeping and therefore cost-effective production of the broom head.

The object initially mentioned is consequently achieved.

The module could be fixed between the plate and a cap. The module can thereby be accommodated positively and/or in a materially integral manner between the plate and cap. The plate and cap may be adhesively bonded, welded or latched to one another.

The module could have a ridge, from which the second cleaning elements, in particular lamellae, project, the second cleaning elements passing through an aperture in the plate. The ridge can serve as an abutment which can be laid against the plate. Moreover, a plurality of individual second cleaning elements arranged in the manner of a palisade can be gripped in their entirety and inserted into the plate.

The cap could have a receptacle for a handle. A broom handle can thereby be plugged onto or screwed to the broom head.

The first cleaning elements could be configured as bristles. The bristles may be manufactured from synthetic materials or from natural fibers.

The second cleaning elements could be manufactured from an elastomer. An elastomer, in particular rubber, can perform an outstanding wiping function.

The second cleaning elements could be manufactured from a foam. Foams are cost-effective and lightweight.

The second cleaning elements could be configured as lamellae. During sweeping, lamellae can pick up and brush away moisture especially effectively with their lamella surface or wiping surface. Moreover, lamellae can loosen stubborn dirt and catch hairs and smaller dirt particles.

The lamellae could have a straight, bent or curved configuration. The geometry of the lamellae may be selected according to the wiping function requirements. It is conceivable to use U-shaped, V-shaped, X-shaped, round or oval lamellae.

The broom head could be manufactured from three individual parts, to be precise from a plate with first cleaning elements, from a cap and from the module. These three individual parts can easily be joined together by hand.

IMPLEMENTATION OF THE INVENTION

Figure 1:
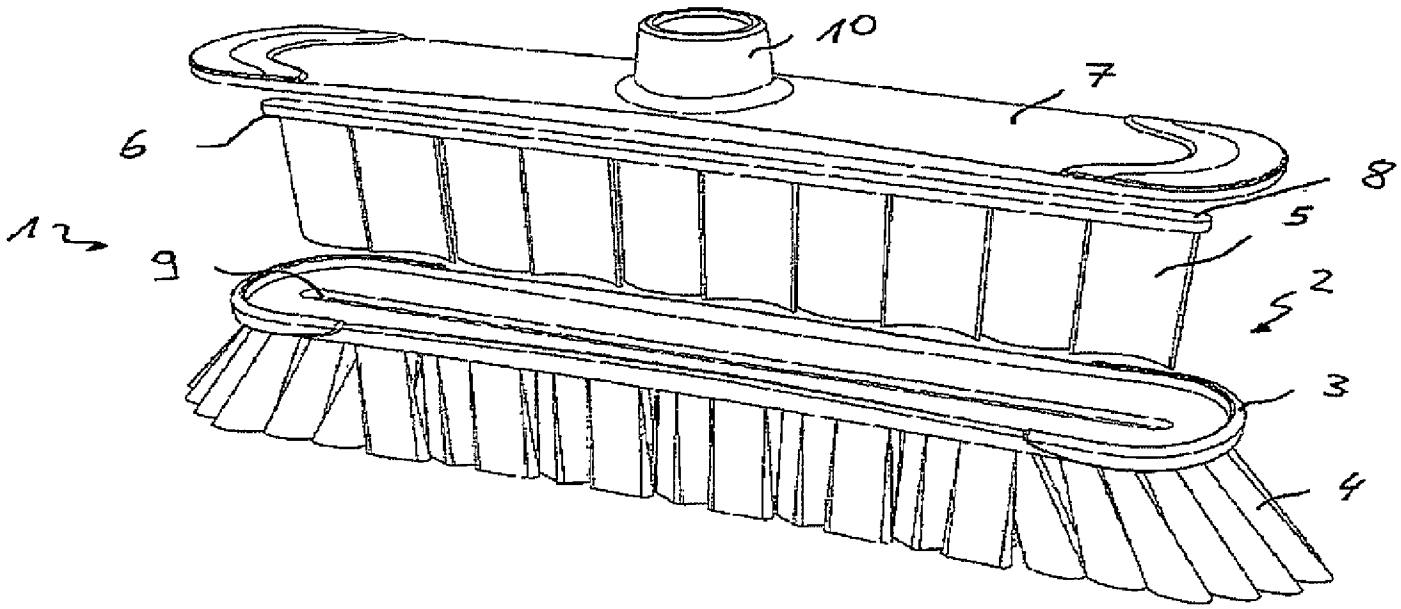
FIG. 1 shows an exploded illustration of a broom head which is composed of three individual parts.

FIG. 1 shows an exploded illustration of a broom head 1 comprising a basic body 2 with a plate 3, from which first cleaning elements 4 to be turned toward a surface to be cleaned project, lamellae, which assist the cleaning capacity of the first cleaning elements 4, also projecting as second cleaning elements 5 from the plate 3.

The second cleaning elements 5, to be precise the lamellae, are arranged on a module 6 which can be inserted as a separate individual part into an aperture 9 of the plate 3 in such a way that the second cleaning elements 5 pass through the plate 3.

The second cleaning elements 5 are arranged on a module 6 which can be inserted as a separate individual part into the plate 3. The module 6 can be fixed between the plate 3 and a cap 7.

Figure 2:
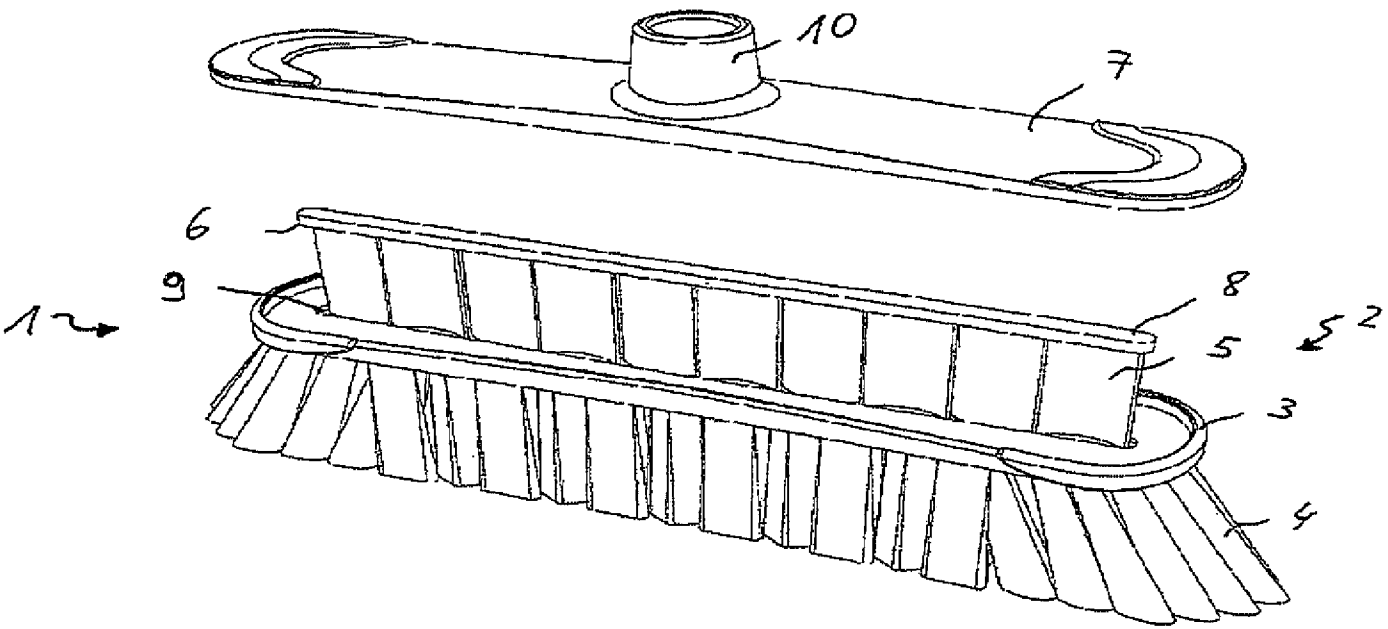
FIG. 2 shows an illustration in which the module is inserted partially into the plate.

FIG. 2 shows that the module 6 has a ridge 8, from which the lamellae project, the lamellae passing through an aperture 9 in the plate 3. The aperture 9 is configured as an elongate slot. A plurality of lamellae are arranged on the ridge 8 and can be introduced together in their entirety into the aperture 9.

The cap 7 has a receptacle 10 for a handle. The receptacle 10 is formed integrally with the cap 7.

The first cleaning elements 4 are configured as bristles. The second cleaning elements 5 are configured as lamellae. The lamellae are surrounded on all sides by the bristles.

The lamellae are curved and have an essentially U-shaped configuration. The lamellae are manufactured from an elastomer. The individual lamellae are arranged in such a way that a convexly curved lamella surface is followed along the ridge 8 by a concavely curved lamella surface.

Figure 3:
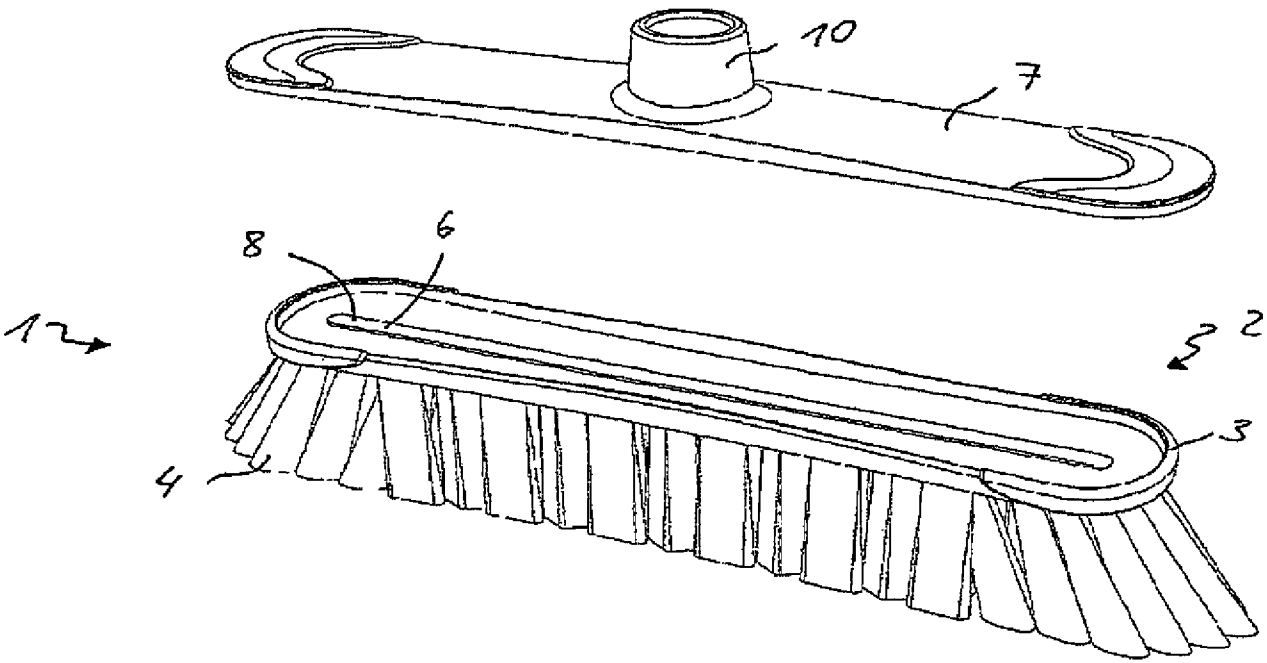
FIG. 3 shows an illustration in which the module is inserted completely into the plate.
Figure 4:
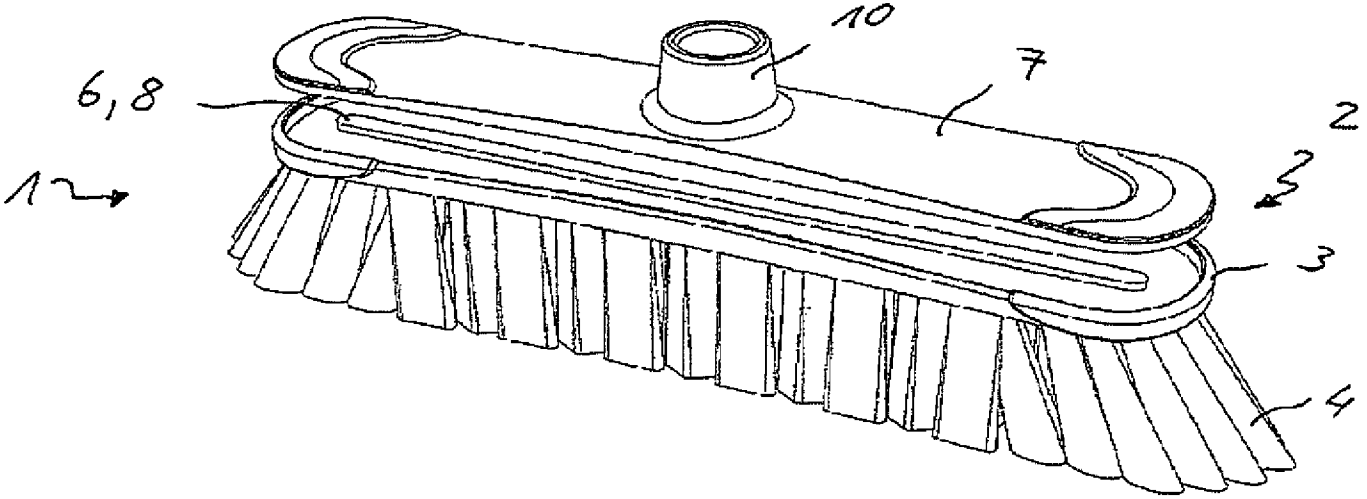
FIG. 4 shows an illustration in which the cap is placed onto the plate.
Figure 5:
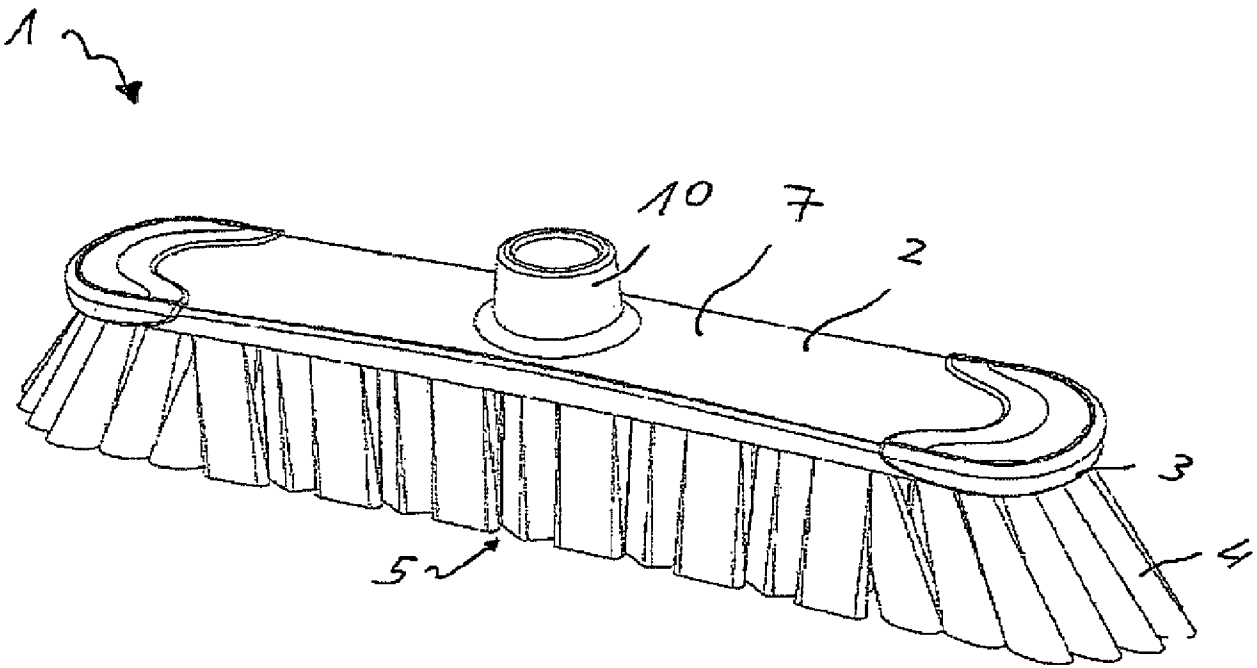
FIG. 5 shows an illustration of the ready-assembled broom head.

FIGS. 3, 4 and 5 show that the broom head 1 is manufactured from three individual parts, to be precise from a plate 3 with first cleaning elements 4, from a cap 7 and from the module 6. FIG. 5 shows the broom head 1 in the ready-assembled state. The three individual parts form the basic body 2.

The invention claimed is:

1. A broom head comprising:

a plate having an aperture formed therein therethrough, the aperture passing from a first face of the plate to a second face of the plate, and a plurality of first cleaning elements extending outwardly therefrom from the second face of the plate towards a surface to be cleaned;

a module having a plurality of second cleaning elements extending outwardly therefrom, an entirety of the second cleaning elements received through the aperture to extend towards the surface to be cleaned, wherein the second cleaning elements are configured as lamellae and the entire module has a flat configuration in the outwardly extending direction of the second cleaning elements;

a cap coupled to the first face of the plate, the module fixed between the plate and the cap; and wherein the cap includes a receptacle formed thereon configured for receiving a handle.

2. The broom head of claim 1, wherein the module includes a ridge having the second cleaning elements arranged thereon and extending outwardly therefrom.

3. The broom head of claim 2, wherein the aperture is configured as an elongate slot.

4. The broom head of claim 2, wherein the ridge serves as an abutment that is laid against the plate.

5. The broom head of claim 1, wherein the first cleaning elements are configured as bristles.

6. The broom head of claim 1, wherein the second cleaning elements are manufactured from an elastomer.

7. The broom head of claim 1, wherein the second cleaning elements are manufactured from a foam.

8. The broom head of claim 1, wherein each of the second cleaning elements has one of a straight configuration, a bent configuration, and a curved configuration.

9. The broom head of claim 1, wherein the cap, the plate, and the module are separately formed from each other and cooperate with each other to form a unitary basic body.

10. The broom head of claim 1, wherein the plate and the cap are one of adhesively bonded, welded, and latched to one another.

11. The broom head of claim 1, wherein the second cleaning elements are arranged as a palisade.

12. The broom head of claim 1, wherein the second cleaning elements are surrounded on all sides by the first cleaning elements.

13. The broom head of claim 1, wherein the lamellae are one of U-shaped, V-shaped, and X-shaped.

14. The broom head of claim 1, wherein the lamellae are one of round and oval.

15. The broom head of claim 1, wherein the lamellae are arranged as an alternating series of lamellae having convexly curved and concavely curved surfaces.

* * * * *